US010370169B2

(12) United States Patent
Yamazaki

(10) Patent No.: US 10,370,169 B2
(45) Date of Patent: Aug. 6, 2019

(54) PACKING DEVICE

(71) Applicant: Mitsubishi Electric Corporation, Tokyo (JP)

(72) Inventor: Masahiro Yamazaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/739,861

(22) PCT Filed: Aug. 27, 2015

(86) PCT No.: PCT/JP2015/074237
§ 371 (c)(1),
(2) Date: Dec. 26, 2017

(87) PCT Pub. No.: WO2017/033330
PCT Pub. Date: Mar. 2, 2017

(65) Prior Publication Data
US 2018/0362239 A1 Dec. 20, 2018

(51) Int. Cl.
*B65D 81/133* (2006.01)
*B65D 81/05* (2006.01)
(Continued)

(52) U.S. Cl.
CPC ..... *B65D 81/133* (2013.01); *B65D 5/5004* (2013.01); *B65D 5/509* (2013.01);
(Continued)

(58) Field of Classification Search
CPC .... B65D 81/133; B65D 5/509; B65D 81/025; B65D 81/03; B65D 81/05; B65D 5/5004;
(Continued)

(56) References Cited

U.S. PATENT DOCUMENTS 2,847,152 A * 8/1958 Van Antwerpen ... B65D 5/5021 206/448
3,445,054 A * 5/1969 Champlin ..... B65D 5/5011 206/424
(Continued)

FOREIGN PATENT DOCUMENTS

FR 2446233 A1 8/1980
JP H09-048487 A 2/1997
(Continued)

OTHER PUBLICATIONS

Office Action dated Oct. 9, 2018 issued in corresponding CN patent application No. 201580082294.X (and English translation).
(Continued)

*Primary Examiner* — Corey N Skurdal
(74) *Attorney, Agent, or Firm* — Posz Law Group, PLC

(57) ABSTRACT

Damage to a packing device and a packed object caused by a load is prevented, and a box and the packed object are protected stably. A box of the packing device includes side surface portions, upper flaps, lower flaps, a protrusion, a fixing portion, and interior cushions. The protrusion is formed by folding part of an upper flap. The fixing portion fixes the protrusion such that the protrusion projects from the upper flap. In a state where an object is accommodated in the box, the protrusion is interposed between the upper flap and the packed object, and disperses the load applied to the box.

21 Claims, 12 Drawing Sheets

(51) Int. Cl.
*B65D 5/50* (2006.01)
*B65D 81/02* (2006.01)
*B65D 81/03* (2006.01)

(52) U.S. Cl.
CPC ..... *B65D 5/5069* (2013.01); *B65D 81/025* (2013.01); *B65D 81/03* (2013.01); *B65D 81/058* (2013.01)

(58) Field of Classification Search
CPC .. B65D 5/5014; B65D 5/5021; B65D 5/2035; B65D 5/0281; B65D 5/2009; B65D 5/505; B65D 5/5016
USPC ..... 229/90
See application file for complete search history.

(56) References Cited

U.S. PATENT DOCUMENTS

| | | | | | |
|---|---|---|---|---|---|
| 4,211,356 | A * | 7/1980 | Tsuchiya | B65D 5/5088 | 206/586 |
| 4,266,715 | A * | 5/1981 | Garrison | B65D 5/5011 | 206/425 |
| 5,372,259 | A * | 12/1994 | Suzuki | B65D 5/5004 | 206/586 |
| 5,871,147 | A * | 2/1999 | Smith | B65D 5/0281 | 206/485 |
| 6,685,026 | B1 * | 2/2004 | Hanna | B65D 5/5021 | 206/454 |
| 7,886,911 | B1 * | 2/2011 | McLaughlin | B65D 5/5016 | 206/521 |
| 2002/0036150 | A1 * | 3/2002 | Knaack | B65D 5/5014 | 206/446 |
| 2005/0211600 | A1 * | 9/2005 | Saito | B65D 5/0227 | 206/586 |
| 2009/0173659 | A1 * | 7/2009 | Li | B65D 5/5004 | 206/588 |
| 2011/0210040 | A1 * | 9/2011 | Urquhart | B65D 5/5004 | 206/592 |

FOREIGN PATENT DOCUMENTS

| | | | |
|---|---|---|---|
| JP | H11-310224 | A | 11/1999 |
| JP | 2002-179151 | A | 6/2002 |
| JP | 2004-284591 | A | 10/2004 |
| JP | 2005-014965 | A | 1/2005 |
| JP | 4271510 | B2 | 1/2005 |
| JP | 2006-103729 | A | 4/2006 |
| JP | 2008-030753 | A | 2/2008 |
| JP | 2011-157128 | A | 8/2011 |
| JP | 2012-091852 | A | 5/2012 |

OTHER PUBLICATIONS

International Search Report of the International Searching Authority dated Dec. 1, 2015 for the corresponding International application No. PCT/JP2015/074237 (and English translation).
International Preliminary Report on Patentability of the International Searching Authority dated Mar. 8, 2018 for the corresponding international application No. PCT/JP2015/074237 (and English translation).
Office Action dated Jan. 29, 2019 issued in corresponding Japanese patent application No. 2017-536149 (and English translation).

* cited by examiner

PACKING DEVICE

CROSS REFERENCE TO RELATED APPLICATION

This application is a U.S. national stage application of International Application No. PCT/JP2015/074237 filed on Aug. 27, 2015, the disclosure of which in incorporated herein by reference

TECHNICAL FIELD

The present invention relates to a packing device for packing various articles.

BACKGROUND ART

As a conventional art, a packing device described in, e.g., PTL 1 is known. FIG. 17 is an exploded perspective view showing the packing device in the conventional art. As shown in the drawing, the packing device in the conventional art includes a quadrangular box 200 in which a packed object 100 is accommodated, and cushioning materials 300 formed by folding cardboard such as corrugated cardboard. The cushioning materials 300 are accommodated in the box 200 together with the packed object 100, and are disposed in gaps between the box 200 and the packed object 100. Flaps 400 are formed integrally on four sides of an opening portion of each of a top surface and a bottom surface of the box 200.

CITATION LIST

Patent Literature

[PTL 1] Japanese Patent Application Publication No. 2006-103729

SUMMARY OF INVENTION

Technical Problem

The conventional art described above has a problem that, in the case where a compressive load acts on the packing device, e.g., during storage in a warehouse, during transport by a truck, or during execution of loading and unloading operations onto and from the truck, the box 200 or the packed object 100 is easily deformed or damaged.

The present invention has been made in order to solve the above problem, and an object thereof is to provide a packing device capable of preventing damage to the packing device and a packed object caused by a load, and protecting a box and the packed object stably.

Solution to Problem

A packing device for packing an object of the invention includes a box formed of at least one corrugated board sheet for accommodating the object. The box has a top surface portion, a bottom surface portion opposite to the top surface portion and a side surface portion connecting the top surface portion and the bottom surface portion to each other. A wall surface portion is at least one of the top surface portion and the bottom surface portion. The wall surface portion has a protrusion formed by partially folding the corrugated board sheet toward an inside of the box. The protrusion abuts on the object accommodated in the box.

Advantageous Effects of Invention

According to the invention, in a state where the object is packed, it is possible to interpose the protrusion between the box and the object. With this, even in the case where packed products are stacked on top of each other in the warehouse or the like, it is possible to prevent the damage to the box caused by the load and protect the box and the packed object stably.

DESCRIPTION OF EMBODIMENTS

Figure 1:
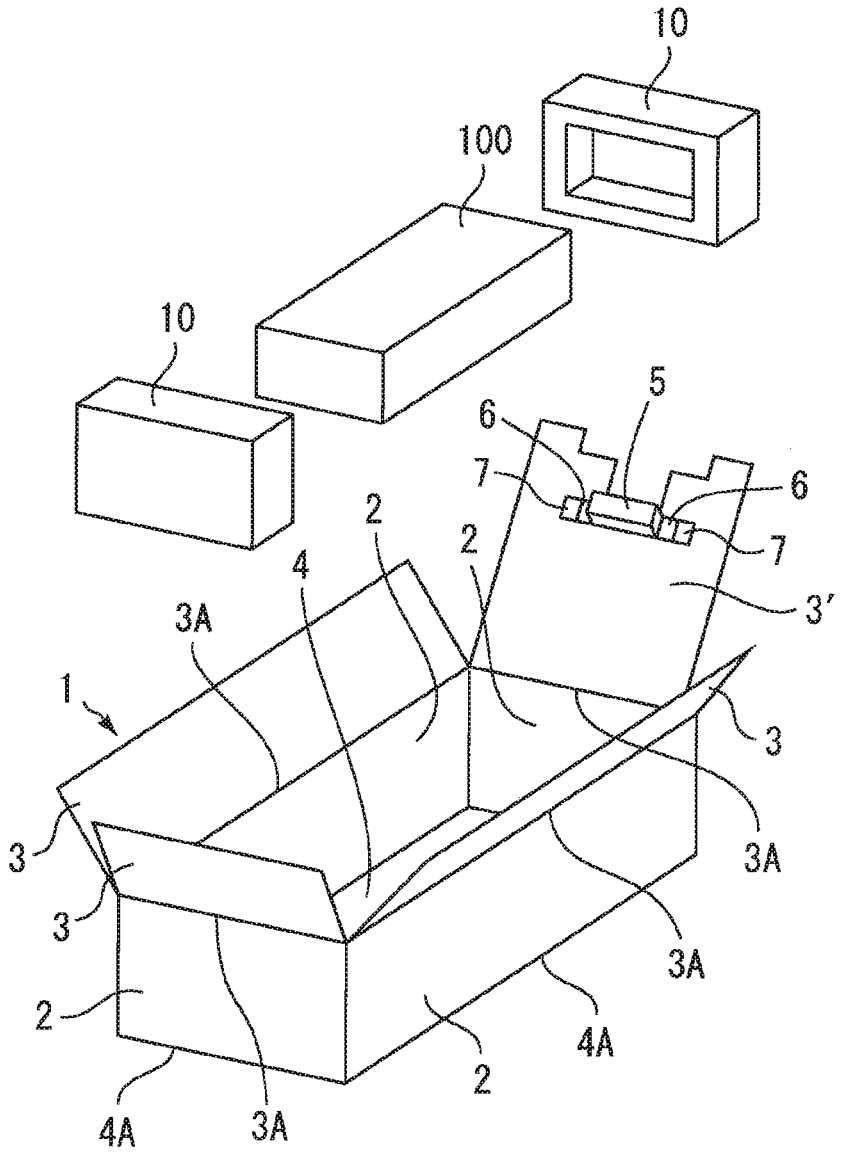
FIG. 1 is an exploded perspective view showing a packing device according to Embodiment 1 of the present invention.

Hereinbelow, with reference to FIGS. 1 to 16, embodiments of the present invention will be described. Note that common elements in the drawings used in the present description are designated by the same reference numerals, and the repeated description thereof will be omitted. In addition, the present invention is not limited to the following embodiments, and can be variously modified without departing from the gist of the present invention. Further, the present invention includes all combinations of configurations described in the embodiments.

Embodiment 1

Figure 2:
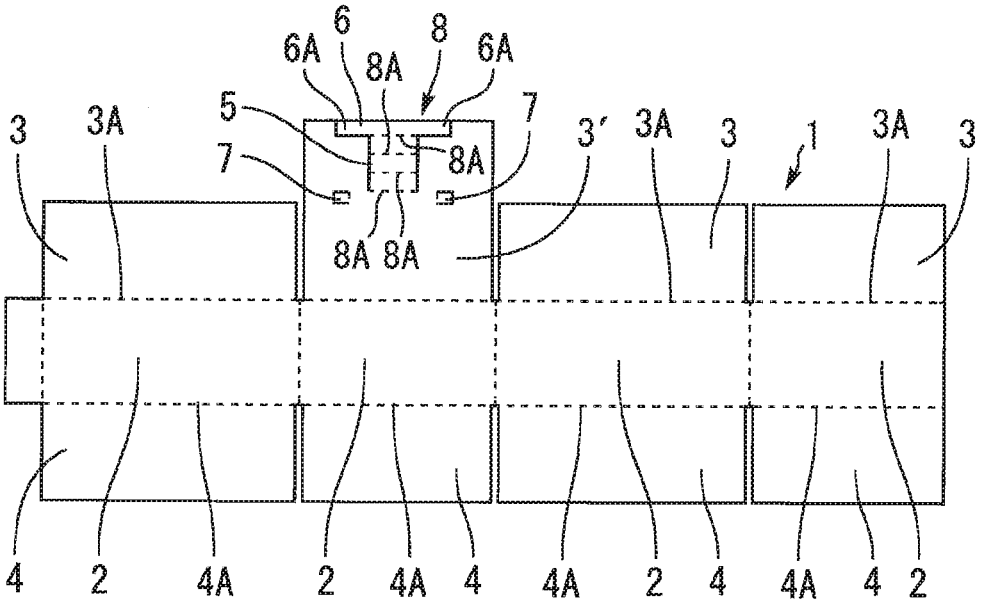
FIG. 2 is a developed view showing a box in FIG. 1.
Figure 3:
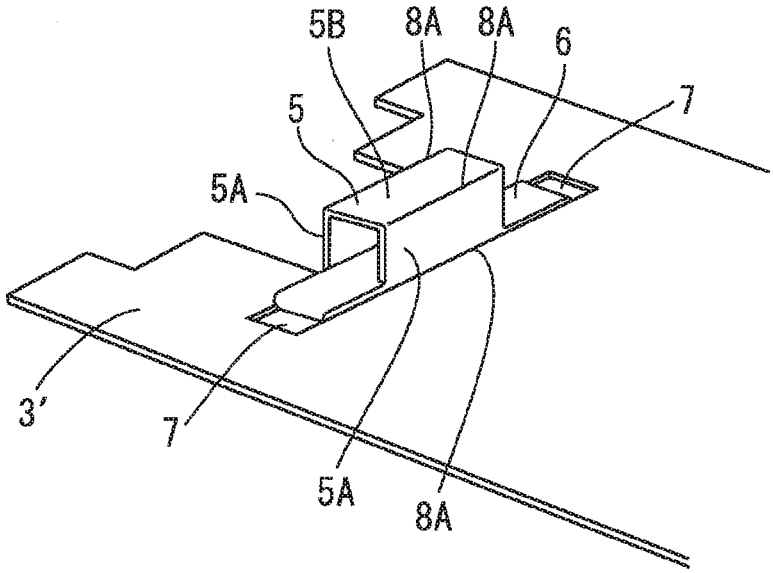
FIG. 3 is a partial enlarged perspective view when a protrusion and a fixing portion in FIG. 1 are viewed from the inside of the box.
Figure 4:
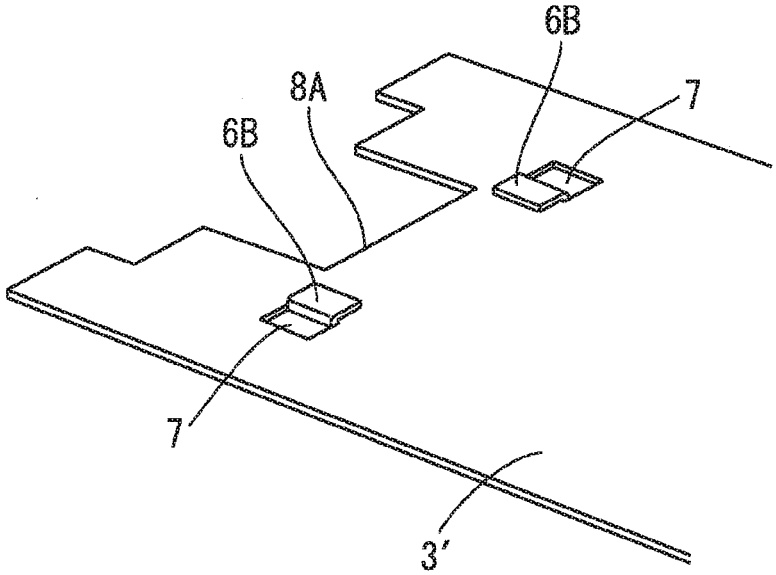
FIG. 4 is a partial enlarged perspective view when a latch portion of the fixing portion is viewed from the outside of the box.
Figure 5:
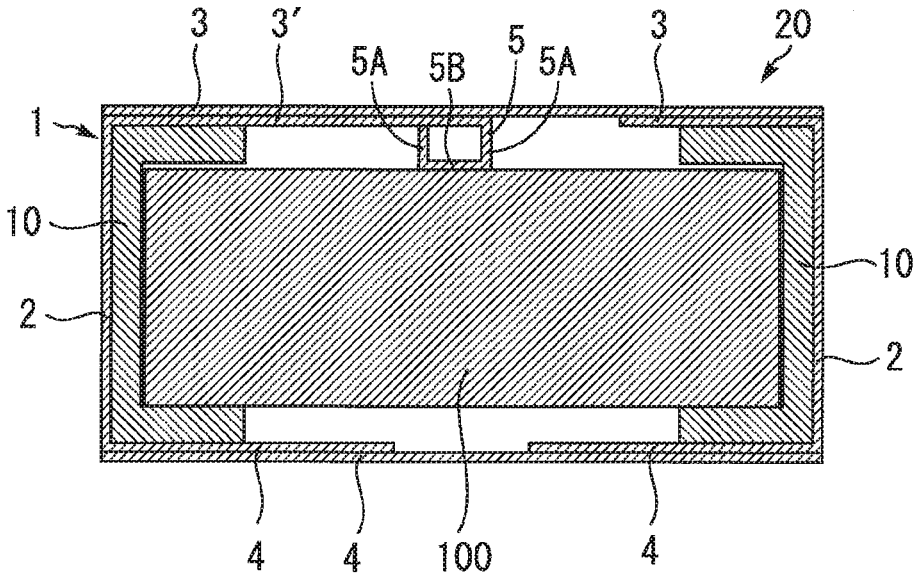
FIG. 5 is a longitudinal sectional view showing a state where an object is packed by the packing device in Embodiment 1 of the present invention.

First, with reference to FIGS. 1 to 7, Embodiment 1 of the present invention will be described. FIG. 1 is an exploded perspective view showing a packing device according to Embodiment 1 of the present invention. FIG. 2 is a developed view showing a box in FIG. 1. In addition, FIG. 3 is a partial enlarged perspective view when a protrusion and a fixing portion in FIG. 1 are viewed from the inside of the box. FIG. 4 is a partial enlarged perspective view when a latch portion of the fixing portion is viewed from the outside of the box. Further, FIG. 5 is a longitudinal sectional view showing a state where an object is packed by the packing device in Embodiment 1 of the present invention. As shown in FIGS. 1, 2, and 5, the packing device of the present embodiment includes a box 1 that is formed into a quadrangular box-like shape, and interior cushions 10 described later. The packing device packs an object 100 that is an object corresponding to one of various products.

The box 1 is formed by incising and folding, e.g., one corrugated board sheet, and is configured to accommodate the packed object 100. Note that, in the present invention, the box 1 may also be formed by using two or more corrugated board sheets. In addition, as shown in FIG. 1, the box 1 has side surface portions 2 on four sides, a plurality of upper flaps 3, and a plurality of lower flaps 4. The side surface portions 2 on the four sides connect the upper flaps 3 and the lower flaps 4 to each other, and are disposed so as to form a quadrangular frame-like shape in a state where the box 1 is assembled.

Each of the upper flaps 3 is folded from the upper end of each side surface portion 2 with a folding line 3A used as a pivot, and the upper flaps 3 are disposed such that at least parts of the upper flaps 3 overlap each other. In this state, each upper flap 3 constitutes a top surface portion of the box 1. Each of the lower flaps 4 is folded from the lower end of each side surface portion 2 with a folding line 4A used as a pivot, and the lower flaps 4 are disposed such that at least parts of the lower flaps 4 overlap each other. In this state, each lower flap 4 opposes the upper flap 3 in a vertical direction, and constitutes a bottom surface portion of the box 1. The side surface portions 2, the upper flaps 3, and the lower flaps 4 constitute wall surface portions of the box 1.

As shown in FIGS. 1 and 3, a protrusion 5 and a fixing portion 6 are formed on the wall surface portion of at least one of the upper flap 3 and the lower flap 4. Note that the present embodiment shows, as an example, the case where the protrusion 5 and the fixing portion 6 are formed on at least one upper flap 3' that is one of the upper flaps 3. However, in the present invention, the protrusions and the fixing portions may be formed on a plurality of the upper flaps 3, and the protrusion and the fixing portion may also be formed on one or a plurality of the lower flaps 4. Further, as will be described later, the protrusion and the fixing portion may be formed on each of the upper flap 3 and the lower flap 4.

The protrusion 5 is formed by partially folding the corrugated board sheet serving as the box 1 toward the inside of the box 1, and projects from the upper flap 3' toward the inside of the box 1 downwardly. As shown in FIG. 3, the protrusion 5 is formed into, e.g., a U shape or a square angled U shape that opens toward the upper flap 3', and includes two leg portions 5A and a protrusion end 5B. The two leg portions 5A rise perpendicularly from the upper flap 3', and oppose each other. The protrusion end 5B is formed as, e.g., a flat surface portion that extends parallel to the upper flap 3', and couples the tip sides of the leg portions 5A to each other. The protrusion end 5B constitutes the most projecting part of the protrusion 5 that projects from the upper flap 3'.

The protrusion 5 is configured to be interposed between the top surface portion of the box 1 and the packed object 100 when the packed object 100 is accommodated in the box 1. At this point, the protrusion end 5B of the protrusion 5 directly abuts on the packed object 100 or is held so as to oppose the packed object 100 via a gap having prescribed dimensions. Note that the prescribed dimensions are the dimensions that allow the protrusion 5 to abut on the packed object 100 when, e.g., an external force that distorts the box 1 is applied to the box 1. With this, the protrusion 5 supports and reinforces the top surface portion of the box 1, and relieves an impact on the packed object 100 to protect the box 1 and the packed object 100 from the impact and the like.

The fixing portion 6 fixes the protrusion 5 such that the protrusion 5 projects perpendicularly from the upper flap 3'. As shown in FIG. 3, the fixing portion 6 is formed as, e.g., an elongated quadrangular flat surface portion, and is integral with the protrusion 5. In addition, the fixing portion 6 abuts on the upper flap 3' in a state where the fixing portion 6 is folded from the protrusion 5. In addition, as shown in FIG. 4, both ends of the fixing portion 6 in a length direction of the protrusion 5 constitute latch portions 6A. The latch portions 6A are folded toward the outside (outer surface side) of the upper flap 3' via notches 7 formed in the upper flap 3', hooked through the notches 7, and fixed. With this, the fixing portion 6 prevents the protrusion 5 from deforming so as to fall by an external force applied to the box 1 or the like, and reinforces the protrusion 5.

Herein, as shown in FIG. 2, the upper flap 3' before the box 1 is assembled is formed with a T-shaped incised piece 8. In addition, the notches 7 are formed on both sides of the incised piece 8. The base end side of the incised piece 8 serves as the protrusion 5, is formed into, e.g., an elongated quadrangular shape, and is formed integrally with the upper flap 3'. The tip side of the incised piece 8 serves as the fixing portion 6, and is bifurcated from the base end side of the incised piece 8. Note that, in the present description, there are cases where an extension direction of the base end side of the incised piece 8 is described as a "length direction of the incised piece 8", and a direction orthogonal to the length direction is described as a "width direction of the incised piece 8".

In the incised piece 8, for example, four folding lines 8A are formed in parallel with each other in the length direction of the incised piece 8 so as to be spaced from each other. The tip side of the incised piece 8 projects to both sides in the width direction from the base end side of the incised piece 8. When the box 1 is assembled, as shown in FIG. 3, the incised piece 8 is bent so as to be wound toward the side of the upper flap 3' while the incised piece 8 is folded orthogonally at the position of each folding line 8A. With this, the protrusion 5 and the fixing portion 6 are formed, and the fixing portion 6 comes into surface contact with the upper flap 3'. Next, both end sides of the fixing portion 6 are inserted into the notches 7 and are folded toward the outside of the upper flap 3', and each latch portion 6A is thereby formed. As a result, as shown in FIG. 4, each latch portion 6A is fixed to the upper flap 3'.

As shown in FIG. 1, for example, two interior cushions 10 are accommodated in the box 1 together with the packed object 100. Each interior cushion 10 is formed of a cushioning material such as a resin foam or paper-based cardboard, and is configured to perform protection, holding, and cushioning of the packed object 100. In addition, the interior cushions 10 arc disposed at positions different from that of the protrusion 5 (preferably positions on both sides of the protrusion 5). Note that the present embodiment shows, as an example, the case where the interior cushion 10 is formed into a quadrangular frame-like shape. In this case, the interior cushion 10 is capable of supporting the packed object 100 having a quadrangular shape (rectangular parallelepiped shape) in a state where both end sides of the packed object 100 are packed. It is preferable to form the interior cushion 10 so as to fit the shape of a product or the like serving as the packed object 100.

Next, with reference to FIG. 5, an accommodation operation of the object 100 to be packed will be described. In the operation, first, the interior cushions 10 are fitted on the ends of the object 100 to be packed, and are accommodated in the box 1. At this point of time, each lower flap 4 of the box 1 is preferably folded toward the inside with the folding line 4A used as the pivot, and fixed with a tape or the like. Next, after the protrusion 5 is assembled, each upper flap 3 is folded with the folding line 3A used as the pivot, and the top surface portion of the box 1 is thereby closed. In this closing operation, after the upper flap 3' is folded first, the upper flap 3 at a position opposite to the upper flap 3' is folded. Subsequently, the remaining two upper flaps 3 are folded in turn, and the folded upper flaps 3 and 3' are then fixed with the tape or the like. As a result, in the box 1, the protrusion 5 and the fixing portion 6 are disposed above the packed object 100. The protrusion 5 directly abuts on the packed object 100 or opposes the packed object 100 via a gap. In this manner, it is possible to assemble a packed product 20 consisting of the box 1, the interior cushions 10, and the packed object 100.

Figure 6:
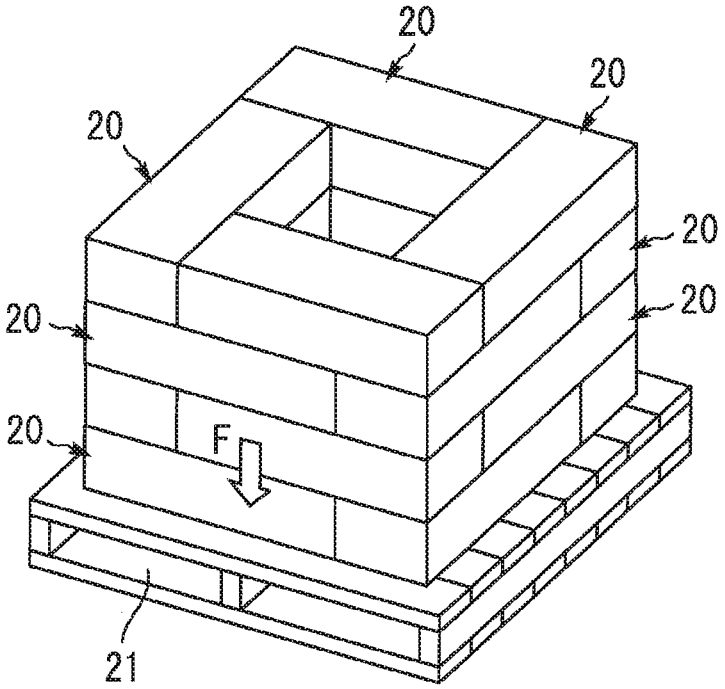
FIG. 6 is a perspective view showing an example of a state where packed products are stacked on top of each other on a pallet.

As described in detail thus far, according to the present embodiment, since the protrusion 5 is formed on the upper flap 3' of the box 1, it is possible to interpose the protrusion 5 between the top surface portion of the box 1 and the packed object 100 in a state where the packed product 20 is assembled. With this, even in the case where the packed products 20 are piled on top of each other (stacked on top of each other) in a warehouse or the like, it is possible to prevent damage such as bending or deformation of the box 1. FIG. 6 is a perspective view showing an example of the state where the packed products 20 are stacked on top of each other on a pallet 21. As shown in the drawing, since a load F applied to the top surface portion of the packed product 20 is supported not only by the side surface portions 2 of the box 1 but also by the protrusion 5 and the packed object 100, it is possible to disperse the load F to protect the box 1 from damage.

Figure 7:
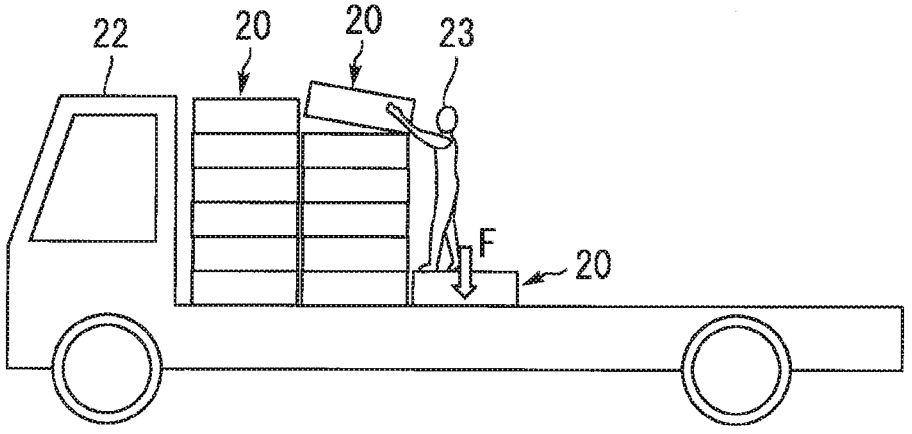
FIG. 7 is an explanatory view showing loading of the packed product onto a truck.

FIG. 7 is an explanatory view showing loading of the packed product 20 onto a truck 22. As shown in the drawing, during the loading operation onto the truck 22, even in the case where a worker 23 gets on the packed product 20, it is possible to disperse the load F applied to the top surface portion of the packed product 20 with the protrusion 5 and the packed object 100. Consequently, it is possible to prevent damage to the box 1 during the loading operation. In addition, in the box 1, the interior cushion 10 having a shape similar to the internal shape of the box 1 is disposed, and the packed object 100 is fitted in the interior cushion 10. As a result, it is possible to hold and protect the packed object 100 while increasing the strength of the box 1 using the interior cushion 10, and further improve the performance of the packing device.

In addition, in the present embodiment, the fixing portion 6 formed integrally with the protrusion 5 is caused to abut on the upper flap 3' so as to be in surface contact with the upper flap 3'. With this, it is possible to prevent the protrusion 5 from deforming so as to fall by the external force or the like applied to the box 1, and fix the protrusion 5 such that the protrusion 5 projects perpendicularly from the upper flap 3'. Further, in the present embodiment, the latch portion 6A of the fixing portion 6 is hooked through the notch 7 of the upper flap 3'. With this, it is possible to prevent the fixing portion 6 from floating from the upper flap 3', and fix the protrusion 5 more stably.

Furthermore, in the present embodiment, the protrusion 5 includes the two leg portions 5A and the protrusion end 5B. As a result, when the external force is applied to the protrusion end 5B from the packed object 100, it is possible to stably support the protrusion end 5B using the two leg portions 5A. Consequently, it is possible to increase the strength of the protrusion 5. Note that, in the present invention, a configuration may also be adopted in which three or more leg portions 5A support the protrusion end 5B.

In addition, in the present embodiment, it is possible to easily form the protrusion 5 and the fixing portion 6 only by folding the T-shaped incised piece 8 formed in the upper flap 3'. Accordingly, it is not necessary to use other components functioning as the protrusion 5 and the fixing portion 6. Consequently, it is possible to reduce the number of components of the packing device to promote a reduction in cost.

Embodiment 2

Figure 8:
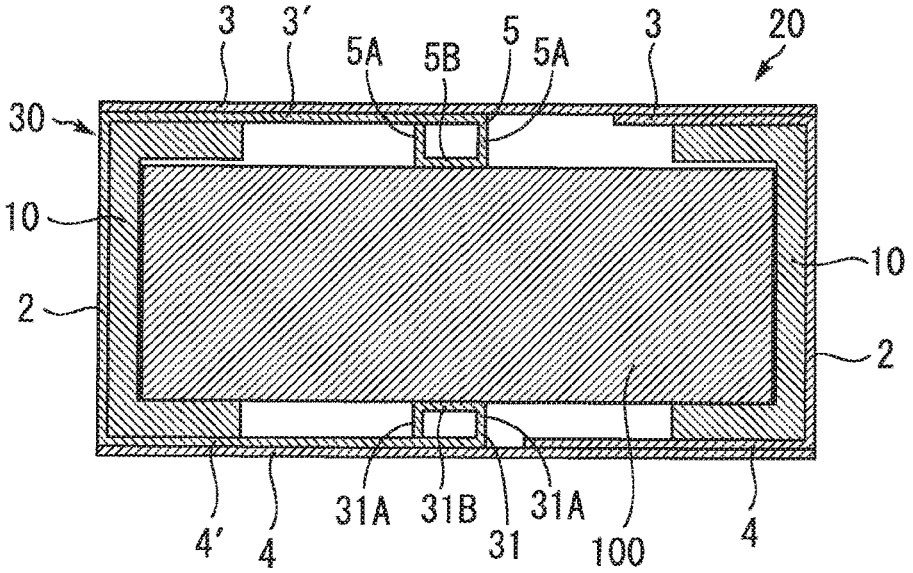
FIG. 8 is a longitudinal sectional view showing a state where an object is packed by a packing device in Embodiment 2 of the present invention.
Figure 9:
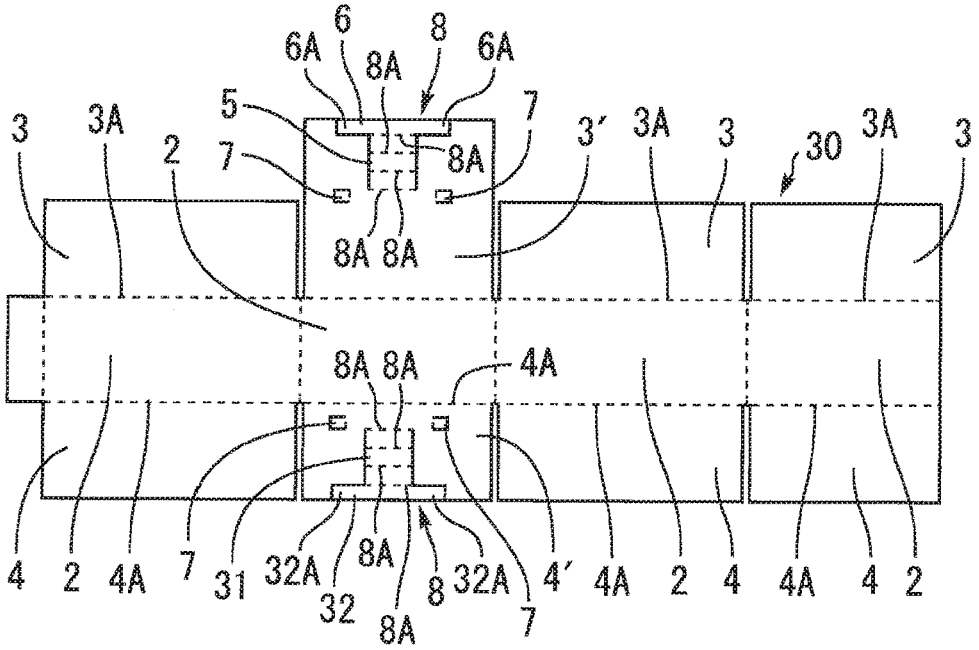
FIG. 9 is a developed view showing a box in FIG. 8.

Next, with, reference to FIGS. 8 and 9, Embodiment 2 of the present invention will be described. The feature of the present embodiment lies in that the protrusion and the fixing portion are formed on each of the top surface portion and the bottom surface portion of the box. FIG. 8 is a longitudinal sectional view showing a state where an object is packed by a packing device in Embodiment 2 of the present invention. FIG. 9 is a developed view showing the box in FIG. 8. As shown in the drawings, the packing device according to the present embodiment includes a box 30. Similarly to Embodiment 1 described above, the box 30 includes the side surface portions 2, the upper flaps 3 and 3', the lower flaps 4, the protrusion 5, and the fixing portion 6. In addition, a protrusion 31 and a fixing portion 32 disposed below the packed object 100 are formed on at least one lower flap 4' that is one of the lower flaps 4 of the box 30.

As shown in FIG. 9, the lower flap 4' is formed with an incised piece 8 similar to that of the upper flap 3'. The protrusion 31 and the fixing portion 32 are formed by folding the incised piece 8 of the lower flap 4' toward the inside of the box 1. In addition, as shown in FIG. 8, the protrusion 31 includes leg portions 31A and a protrusion end 31B similar to those of the upper protrusion 5, and projects from the lower flap 4' upwardly. The fixing portion 32 includes latch portions 32A that are hooked through the two notches 7 formed in the lower flap 4'.

In the thus configured present embodiment, it is possible to interpose the protrusion 31 between the bottom surface portion of the box 1 and the packed object 100 when the packed product 20 is assembled. As a result, it is possible to disperse the load on both of upper and lower sides of the box 30 by using the upper protrusion 5 and the lower protrusion 31. Consequently, in addition to the effect similar to that of Embodiment 1 described above, it is possible to further increase the strength of the box 30. In addition, it is possible to effectively prevent the damage to the box 30 in the stacking and the loading.

Embodiment 3

Figure 10:
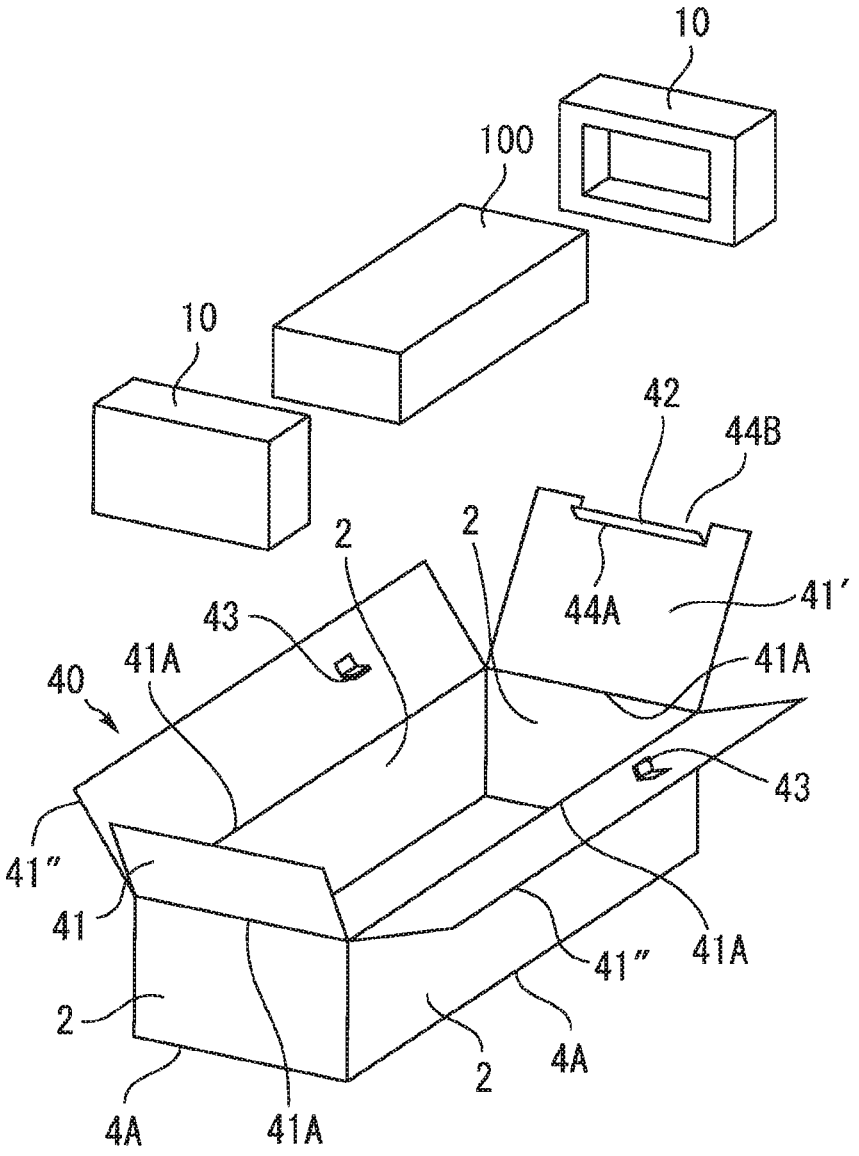
FIG. 10 is an exploded perspective view showing a packing device according to Embodiment 3 of the present invention.
Figure 11:
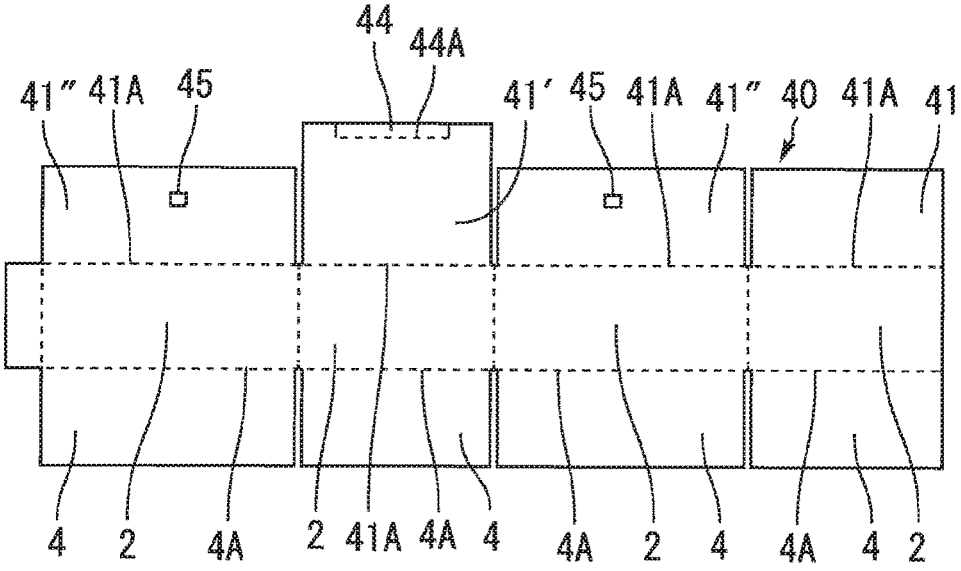
FIG. 11 is a developed view showing a box in FIG. 10.
Figure 12:
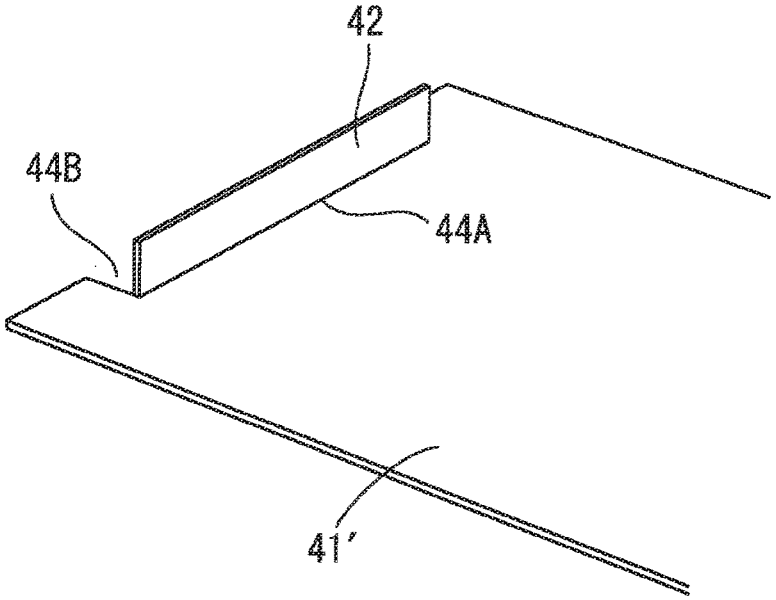
FIG. 12 is a partial enlarged perspective view when a protrusion in FIG. 10 is viewed from the inside of the box.
Figure 13:
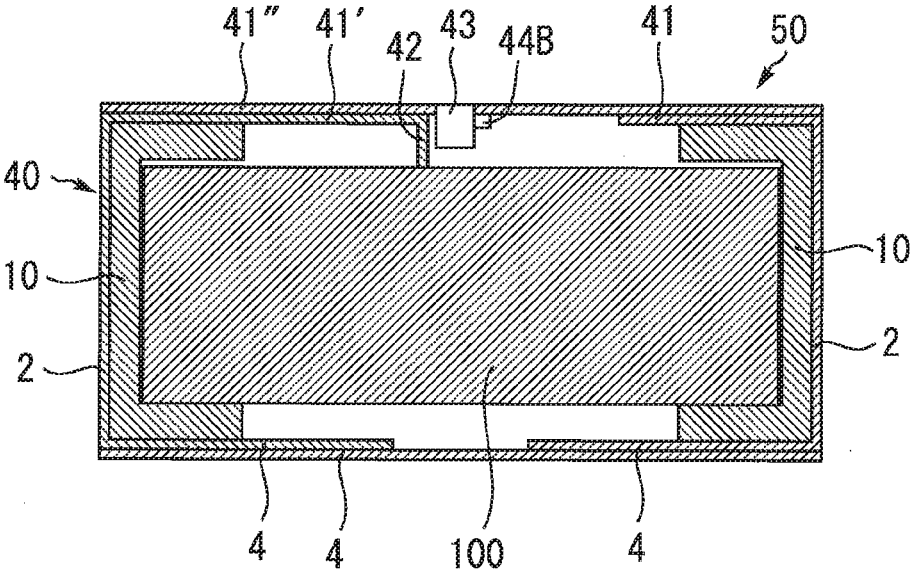
FIG. 13 is a longitudinal sectional view showing a state where an object is packed by the packing device in Embodiment 3 of the present invention.

Next, with reference to FIGS. 10 to 13, Embodiment 3 of the present invention will be described. The feature of the present embodiment lies in that a fixing portion is formed on a wall surface portion of a box. FIG. 10 is an exploded perspective view showing a packing device according to Embodiment 3 of the present invention. FIG. 11 is a developed view showing a box in FIG. 10. In addition, FIG. 12 is a partial enlarged perspective view when a protrusion in FIG. 10 is viewed from the inside of the box. FIG. 13 is a longitudinal sectional view showing the state where an object is packed by the packing device in Embodiment 3 of the present invention.

As shown in the drawings, the packing device according to the present embodiment includes a box 40. Substantially similarly to Embodiment 1 described above, the box 40 includes the side surface portions 2, upper flaps 41, the lower flaps 4, a protrusion 42, and fixing portions 43. Each upper flap 41 is folded along a folding line 41A, and constitutes the top surface portion of the box 40. The protrusion 42 having a shape different from that in Embodiment 1 is formed on at least one upper flap 41' that is one of the upper flaps 41. In addition, the fixing portion 43 having, e.g., a quadrangular shape is formed on each of two upper flaps 41" adjacent to the upper flap 41' in the developed view shown in FIG. 11.

As shown in FIGS. 11 and 12, the protrusion 42 is formed by folding a first incised piece 44 formed in an edge portion of the upper flap 41' along a folding line 44A downwardly. With this, the protrusion 42 projects perpendicularly from the upper flap 41' toward the inside of the box 40. The incised piece 44 is formed into, e.g., an elongated quadrangular strip-like shape, and one long side constituting the quadrangle coincides with the folding line 44A. That is, the protrusion 42 is integral with the top surface portion (the upper flap 41') of the box 40.

In addition, as shown in FIG. 13, in a state where a packed product 50 is assembled, the protrusion 42 abuts on the packed object 100 or opposes the packed object 100 via the gap having the prescribed dimensions. With this, the protrusion 42 exerts the effect similar to that of the protrusion 5 in Embodiment 1. Note that, as shown in FIG. 12, an opening 44B is formed at a position where the incised piece 44 before being folded has been present in a state where the protrusion 42 is formed.

As shown in FIG. 10, the two fixing portions 43 are formed by folding second incised pieces 45 formed in the individual upper flaps 41" orthogonally toward the inside of the box 40. That is, each fixing portion 43 is integral with the top surface portion (the upper flap 41") of the box 40. As shown in FIG. 13, in a state where the box 40 is assembled, each fixing portion 43 projects over the opening 44B formed after the first incised piece 44 is folded, and prevents the protrusion 42 from falling in the direction of the opening 44B. Specifically, the two fixing portions 43 project over the opening 44B on both sides in a length direction of the protrusion 42, and fix the protrusion 42 such that the protrusion 42 projects perpendicularly from the upper flap 41'.

In the thus configured present embodiment as well, as shown in FIG. 13, it is possible to assemble the packed product 50, and obtain the effect substantially similar to that in Embodiment 1 described above. In particular, in the present embodiment, each fixing portion 43 is formed on the upper flap 41" of the box 40. With this, when the box 40 is assembled, it is possible to simplify the shape of each of the incised pieces 44 and 45 and reduce the complicated folding operation as compared with Embodiment 1. Consequently, it is possible to efficiently perform the assembly operation of the box 40.

Embodiment 4

Figure 14:
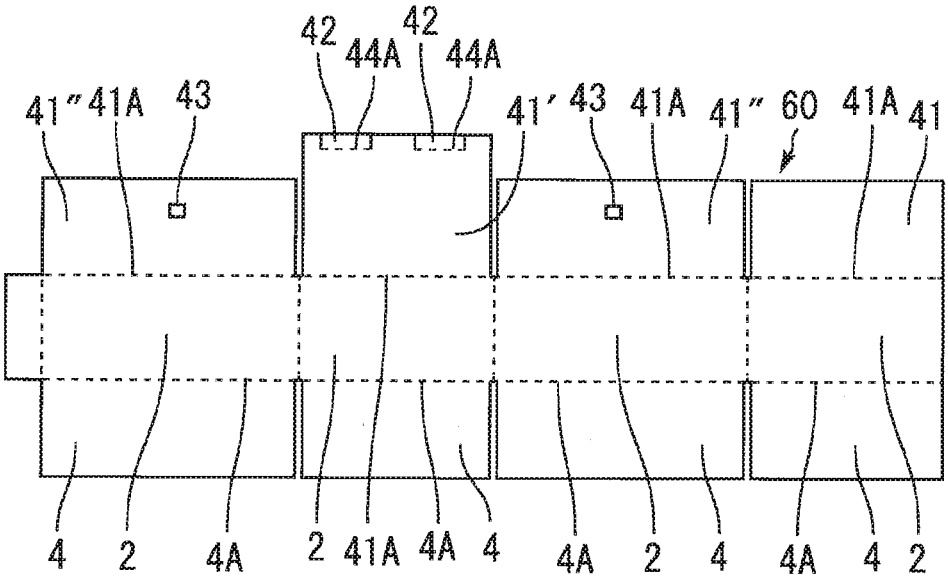
FIG. 14 is a developed view showing a box of a packing device according to Embodiment 4 of the present invention.

Next, with reference to FIG. 14, Embodiment 4 of the present invention will be described. The feature of the present embodiment lies in that a plurality of protrusions and fixing portions formed in the same manner as that in Embodiment 3 described above are provided. FIG. 14 is a developed view showing a box of a packing device according to Embodiment 4 of the present invention. As shown in the drawing, the packing device according to the present embodiment includes a box 60. Substantially similarly to Embodiment 3, the box 60 includes the side surface portions 2, the upper flaps 41, the lower flaps 4, the protrusions 42, and the fixing portions 43. However, two protrusions 42 are formed on one upper flap 41'. In addition, the fixing portions 43 formed on the upper flaps 41" are configured to individually fix the two protrusions 42.

In the thus configured present embodiment as well, it is possible to obtain the effect substantially similar to that in Embodiment 3 described above. In particular, in the present embodiment, it is possible to interpose a plurality of the protrusions 42 between the packed object 100 and the top surface portion of the box 60. With this, in the case where the load is applied to the center of the packing device, it is possible to further promote the dispersion of the load and prevent the damage to the box 60 in the stacking and the loading more reliably.

Embodiment 4 described above has shown, as an example, the case where the two protrusions 42 are formed. However, the present invention is not limited thereto, and three or more protrusions 42 may be formed. According to this configuration, it is possible to provide protrusions 42 the number of which is suitable for, e.g., the transport environment of the packing device and the content of the packed object 100 in the box 60. Consequently, it is possible to easily achieve the packing device that satisfies required strength and reliability. Note that, in FIG. 14, in order to depict the protrusions and the fixing portions in the developed view, the incised pieces before being folded are designated by the reference numerals of the protrusion 42 and the fixing portion 43.

Embodiment 5

Figure 15:
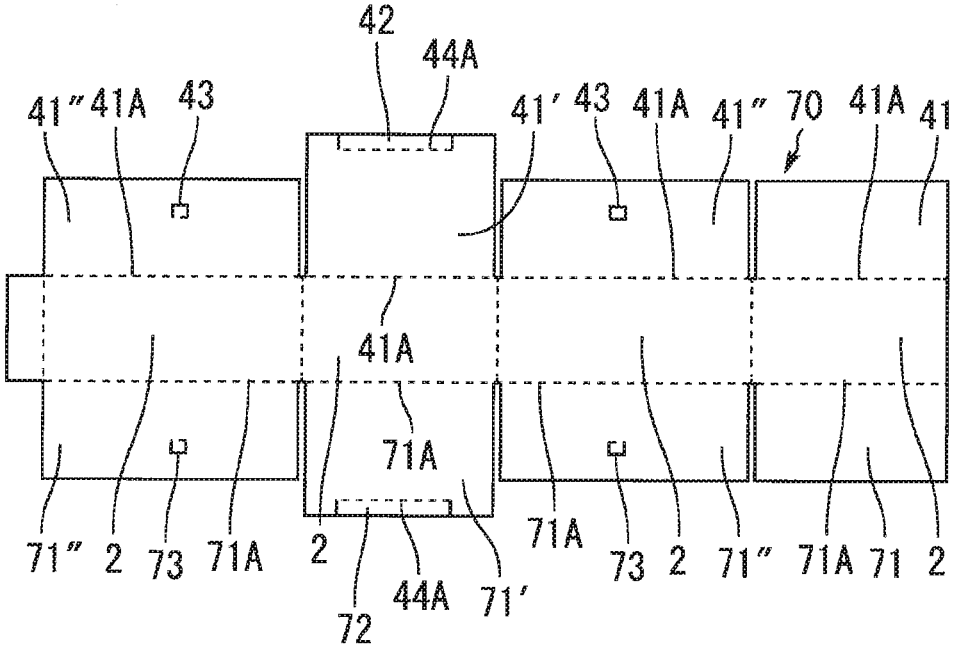
FIG. 15 is a developed view showing a box of a packing device according to Embodiment 5 of the present invention.

Next, with reference to FIG. 15, Embodiment 5 of the present invention will be described. The feature of the present embodiment lies in that a configuration is adopted in which a top surface portion and a bottom surface portion of a box include protrusions and fixing portions similar to those in Embodiment 3 described above. FIG. 15 is a developed view showing a box of a packing device according to Embodiment 5 of the present invention. As shown in the drawing, the packing device according to the present embodiment includes a box 70. Substantially similarly to Embodiment 3 described above, the box 70 includes the side surface portions 2, the upper flaps 41, lower flaps 71, the protrusion 42, and the fixing portions 43. Each lower flap 71 is folded along a folding line 71A, and constitutes the bottom surface portion of the box 70.

A protrusion 72 is formed on one lower flap 71' that is one of the lower flaps 71. In addition, a fixing portion 73 is formed on each of two lower flaps 71" adjacent to the lower flap 71'. The lower protrusion 72 and the lower fixing portion 73 have the same functions as those of the upper protrusion 42 and the upper fixing portion 43.

In the thus configured present embodiment as well, it is possible to obtain the effect similar to that of each of Embodiments 1 to 3 described above, and disperse the load on both of upper and lower sides of the box 70 by using the protrusions 42 and 72 that are simplified in structure. Note that, in FIG. 15, in order to depict the protrusions and the fixing portions in the developed view, the incised pieces before being folded are designated by the reference numerals of the protrusion 42, the fixing portion 43, the protrusion 72, and the fixing portion 73.

Figure 16:
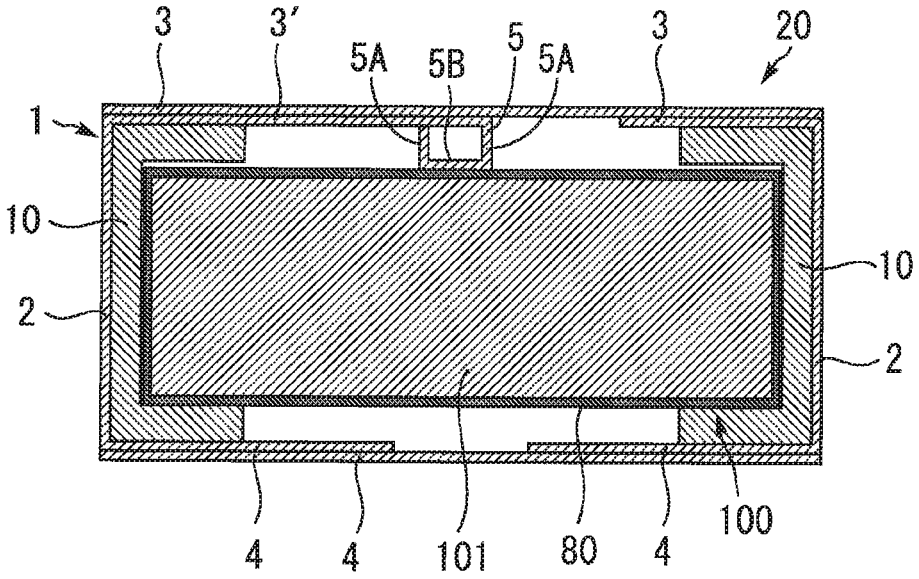
FIG. 16 is a longitudinal sectional view showing a modification that uses a storage bag by using Embodiment 1 of the present invention as an example.
Figure 17:
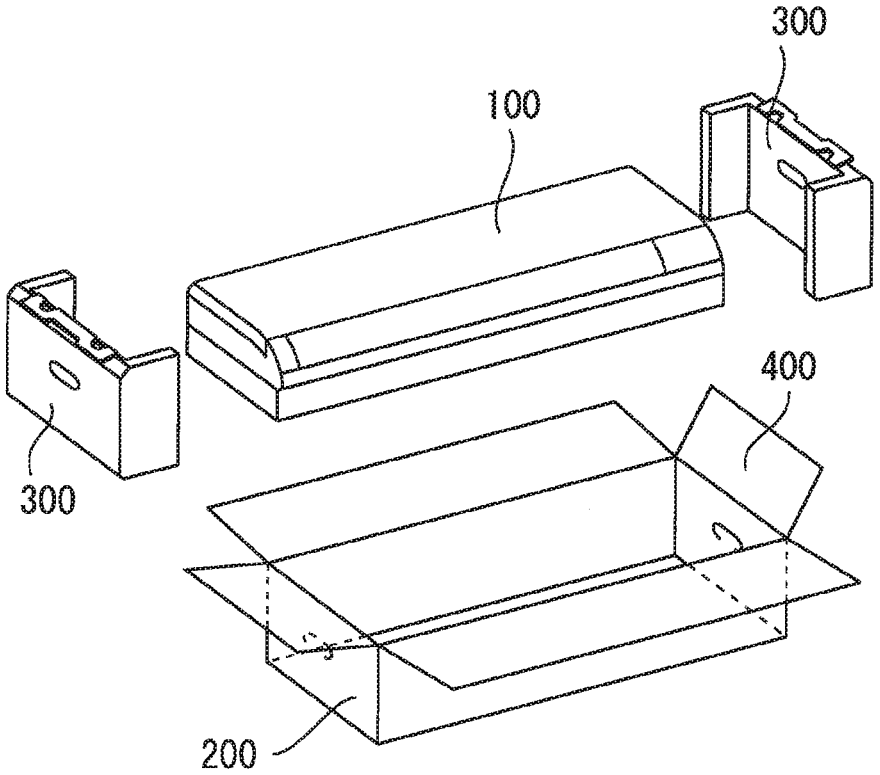
FIG. 17 is an exploded perspective view showing a packing device in the conventional art.

As described above, each of Embodiments described above has shown, as an example, the case where the object 100 is directly accommodated in each of the boxes 1, 30, 40, 60, and 70. However, the present invention is not limited thereto and, for example, the configuration of a modification shown in FIG. 16 may also be adopted. FIG. 16 is a longitudinal sectional view showing the modification that uses a storage bag by using Embodiment 1 of the present invention as an example. In this drawing, the packed object 100 is constituted by wrapping an article 101 in a storage bag 80. The storage bag 80 is formed of a cloth material having cushioning characteristics, and is interposed between the article 101 and the protrusion 5.

According to the thus configured modification, it is possible to protect the article 101 with the storage bag 80 having cushioning characteristics. In addition, even in the case where a gap is present between the protrusion 5 and the article 101 in a state where the article 101 is packed without using the storage bag 80, it is possible to fill the gap with the storage bag 80. With this, it is possible to achieve the dispersion of the load via the protrusion 5 more stably. Note that the modification described above has shown, as an example, the case where the modification is applied to Embodiment 1, but the modification may also be applied to any of Embodiments 2 to 5.

Embodiments 1 to 5 described above have shown, as examples, the cases where the protrusions 5, 31, 42, and 72 and the fixing portions 6, 32, 43, and 73 are used in combination. However, the present invention is not limited thereto, and a configuration may also be adopted in which the fixing portion is not used and only the protrusion is used. In addition, in the present invention, a configuration may also be adopted in which a plurality of the protrusions 5 shown in Embodiment 1 are formed on at least one of the top surface portion and the bottom surface portion of the box.

REFERENCE SIGNS LIST

1, 30, 40, 60, 70 box
2 side surface portion (wall surface portion)
3, 3', 41, 41', 41" upper flap (top surface portion, wall surface portion)
4, 4', 71, 71', 71" lower flap (bottom surface portion, wall surface portion)
3A, 4A, 8A, 41A, 44A, 71A folding line
5, 31, 42, 72 protrusion
5A, 31A leg portion
5B, 31B protrusion end
6, 32, 43, 73 fixing portion
6A, 32A latch portion
7 notch
8, 44, 45 incised piece
10 interior cushion (cushioning material)
20, 50 packed product
21 pallet
22 truck
44B opening
80 storage bag
100 packed object (object)
101 article

The invention claimed is:

1. A packing device for packing an object, comprising:

a box formed of at least one corrugated board sheet for accommodating the object, the box having a top surface portion, a bottom surface portion opposite to the top surface portion and a side surface portion connecting the top surface portion and the bottom surface portion to each other;

wall surface portions being the top surface portion and the bottom surface portion respectively, each wall surface portion respectively having a protrusion formed by partially folding the corrugated board sheet toward an inside of the box, the protrusion abutting on the object accommodated in the box, wherein the protrusion includes at least two leg portions rising perpendicularly from the wall surface portion in a state where the leg portions oppose each other and a protrusion end coupling tip sides of the leg portions to each other, wherein a first protrusion and a second protrusion are the protrusions of the top surface portion and the bottom surface portion respectively, wherein the protrusion ends of the first protrusion and the second protrusion abut on a top surface and a bottom surface respectively of the object, wherein the first protrusion and the second protrusion are located at the same position with respect to a position in a direction parallel to the top surface portion and the bottom surface portion, and wherein the first protrusion and the second protrusion are configured to support a part of a load applied to the top surface portion.

2. The packing device for packing an object according to claim 1, further comprising a fixing portion fixing the protrusion such that the protrusion projects from the wall surface portion.

3. The packing device for packing an object according to claim 2, wherein the fixing portion is formed integrally with the protrusion, and abuts on the wall surface portion in a state where the fixing portion is folded from the protrusion.

4. The packing device for packing an object according to claim 2, wherein the fixing portion is formed integrally with the wall surface portion, and prevents the protrusion from falling in a state where the fixing portion is folded from the wall surface portion.

5. The packing device for packing an object according to claim 4, wherein the wall surface portion is formed with a first incised piece formed into a quadrangular strip-like shape and serving as the protrusion by being folded from the wall surface portion along one side of the quadrangle, and a second incised piece formed by folding part of the wall surface portion and projecting over an opening formed after the first incised piece is folded to serve as the fixing portion.

6. The packing device for packing an object according to claim 2, wherein the fixing portion is formed integrally with the protrusion and abuts on the wall surface portion in a state where the fixing portion is folded from the protrusion, and part of the fixing portion is hooked on an outside of the wall surface portion via a notch formed in the wall surface portion.

7. The packing device for packing an object according to claim 2, wherein the wall surface portion is formed with a T-shaped incised piece having a base end side integral with the wall surface portion and a bifurcated tip side, and the protrusion and the fixing portion are formed by folding the incised piece from the wall surface portion.

8. The packing device for packing an object according to claim 1, further comprising a cushioning material accommodated in the box together with the object, the cushioning material holding or protecting the object at a position different from a position of the protrusion.

9. The packing device for packing an object according to claim 1, wherein the object is an article wrapped in a storage bag.

10. The packing device for packing an object according to claim 1, further comprising a cushioning material accommodated in the box, the object being fitted in the cushioning material.

11. The packing device for packing an object according to claim 1, wherein the wall surface portion is formed with an incised piece.

12. A packing device for packing an object, comprising:

a box formed of at least one corrugated board sheet for accommodating the object, the box having a top surface portion, a bottom surface portion opposite to the top surface portion and a side surface portion connected to the top surface portion and the bottom surface portion;

wall surface portions being of the top surface portion and the bottom surface portion respectively, each wall surface portion respectively having a protrusion formed by partially folding the corrugated board sheet toward an inside of the box, and a fixing portion fixing the protrusion such that the protrusion projects from the wall surface portion, wherein the protrusion includes at least two leg portions rising perpendicularly from the wall surface portion in a state where the leg portions oppose each other and a protrusion end coupling tip sides of the leg portions to each other, wherein a first protrusion and a second protrusion are the protrusions of the top surface portion and the bottom surface portion respectively, wherein the protrusion end of the first protrusion and the second protrusion abut on a top surface and a bottom surface respectively of the object, wherein the first protrusion and the second protrusion are located at the same position with respect to a position in a direction parallel to the top surface portion and the bottom surface portion, and wherein the first protrusion and the second protrusion are configured to support a part of a load applied to the top surface portion.

13. The packing device for packing an object according to claim 12, wherein the fixing portion is formed integrally with the protrusion, and abuts on the wall surface portion in a state where the fixing portion is folded from the protrusion.

14. The packing device for packing an object according to claim 12, wherein the fixing portion is formed integrally with the wall surface portion, and prevents the protrusion from falling in a state where the fixing portion is folded from the wall surface portion.

15. The packing device for packing an object according to claim 14, wherein the wall surface portion is formed with a first incised piece formed into a quadrangular strip-like shape and serving as the protrusion by being folded from the wall surface portion along one side of the quadrangle, and a second incised piece formed by folding part of the wall surface portion and projecting over an opening formed after the first incised piece is folded to serve as the fixing portion.

16. The packing device for packing an object according to claim 12, wherein the fixing portion is formed integrally with the protrusion and abuts on the wall surface portion in a state where the fixing portion is folded from the protrusion, and part of the fixing portion is hooked on an outside of the wall surface portion via a notch formed in the wall surface portion.

17. The packing device for packing an object according to claim 12, wherein the wall surface portion is formed with a T-shaped incised piece having a base end side integral with the wall surface portion and a bifurcated tip side, and the protrusion and the fixing portion are formed by folding the incised piece from the wall surface portion.

18. The packing device for packing an object according to claim 12, further comprising a cushioning material accommodated in the box together with the object, the cushioning body holding or protecting the object at a position different from a position of the protrusion.

19. The packing device for packing an object according to claim 12, wherein the object is an article wrapped in a storage bag.

20. The packing device for packing an object according to claim 12, further comprising a cushioning material accommodated in the box, the object being fitted in the cushioning material.

21. The packing device for packing an object according to claim 12, wherein the wall surface portion is formed with an incised piece.

* * * * *